US008444284B2

(12) United States Patent
Malone

(10) Patent No.: US 8,444,284 B2
(45) Date of Patent: May 21, 2013

(54) TIED SHOE LACE LIGHTS

(76) Inventor: Robert Malone, Garland, TX (US)

( * ) Notice: Subject to any disclaimer, the term of this patent is extended or adjusted under 35 U.S.C. 154(b) by 175 days.

(21) Appl. No.: 13/160,644

(22) Filed: Jun. 15, 2011

(65) Prior Publication Data

US 2011/0310591 A1 Dec. 22, 2011

Related U.S. Application Data

(60) Provisional application No. 61/355,874, filed on Jun. 17, 2010.

(51) Int. Cl.
*F21V 21/08* (2006.01)

(52) U.S. Cl.
USPC ..... 362/103

(58) Field of Classification Search
USPC ..... 362/103
See application file for complete search history.

(56) References Cited

U.S. PATENT DOCUMENTS

| | | | |
|---|---|---|---|
| 4,935,851 | A | 6/1990 | Wood |
| 5,438,488 | A | 8/1995 | Dion |
| 2009/0267537 | A1 | 10/2009 | Rubinstin |

*Primary Examiner* — Jason Moon Han
(74) *Attorney, Agent, or Firm* — Lyman H. Smith

(57) ABSTRACT

A shoe lace-shaped light may be attached to a user's shoes, bedroom slippers, shoelaces, or similar footwear, for example. The shoe lace-shaped light may be pre-folded and pre-tied and may not become unfolded or untied. The shoe lace-shaped light may be powered by, for example, one or more batteries and/or solar power. The lights may be LED lights and may be made as part of the pre-folded, pre-tied shoe laces.

11 Claims, 2 Drawing Sheets

TIED SHOE LACE LIGHTS

CROSS-REFERENCE TO RELATED APPLICATIONS

This application claims the benefit of priority to U.S. provisional patent application No. 61/355,874, filed Jun. 17, 2010, the contents of which are herein incorporated by reference.

BACKGROUND OF THE INVENTION

The present invention relates to shoe lace-shaped lights and, more particularly, to pre-folded strings that attaches to, with light emitting diode (LED) lights inside the strings, to a person's shoe.

Conventional shoes may include lights that may attach to the shoes or that may be integral with the shoes. These conventional lights, when integrated, are often part of the shoe's sole. Other times, these conventional lights may be attached to a person's shoe, but may not be aesthetically pleasing as an add-on device.

As can be seen, there is a need for a light for a shoe that may be designed in such a way to mimic that of ordinary shoe laces.

SUMMARY OF THE INVENTION

In one aspect of the present invention, a light assembly comprises a shoe lace looking material shaped similar to a laced and tied shoe lace; a housing encasing the shoe lace looking material, the housing retaining the shoe lace looking material in its shape and preventing untying thereof; a light disposed in the housing; a power pack adapted to provide power to the light; and an attachment device adapted to attach the light assembly to a shoe.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a shoe lace-shaped light that may be attached to a user's shoes, shoestrings, bedroom slippers, or any related footwear. The shoe lace-shaped light may be pre-folded and pre-tied and may not become unfolded or untied. The shoe lace-shaped light may be powered by, for example, one or more batteries and/or solar power. The lights may be LED lights and may be made as part of the pre-folded, pre-tied shoe laces.

Figure 1:
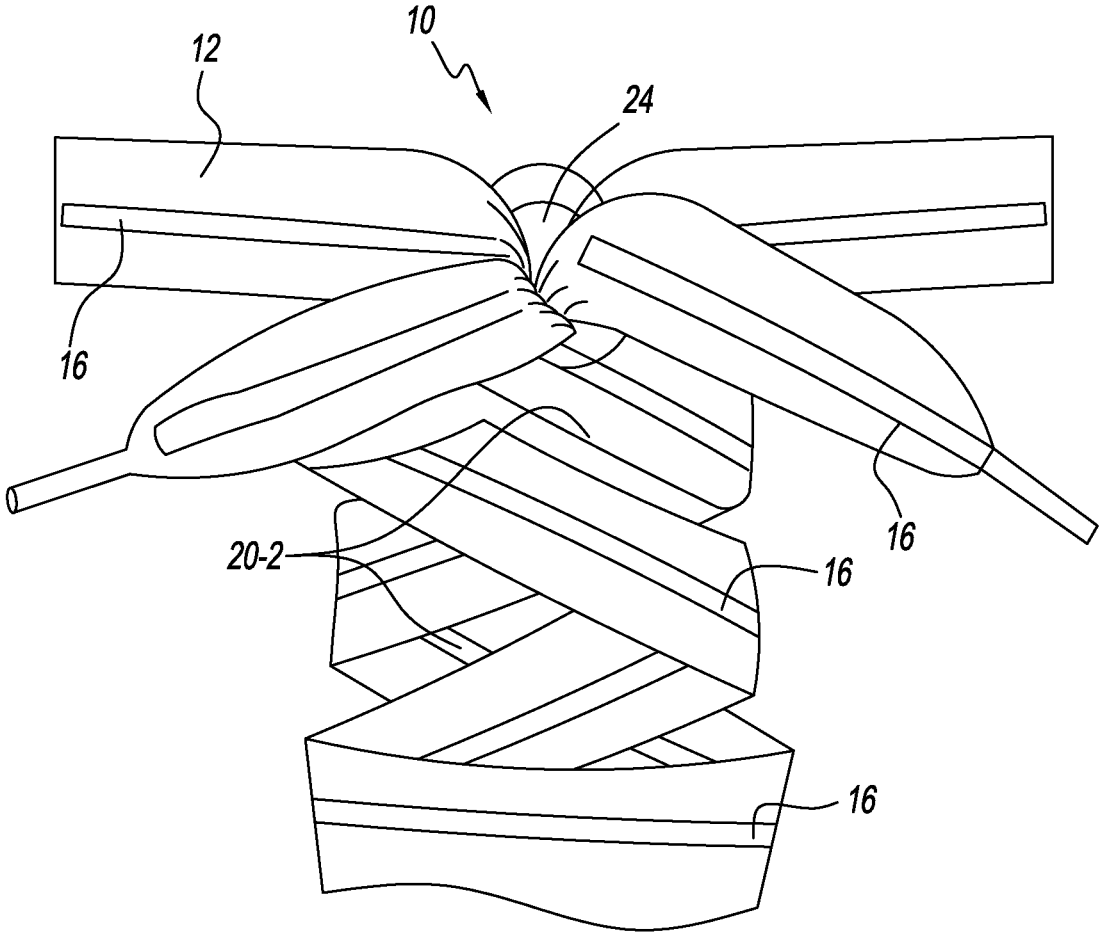
FIG. 1 is a front view of shoe lace lights according to an exemplary embodiment of the present invention.
Figure 2:
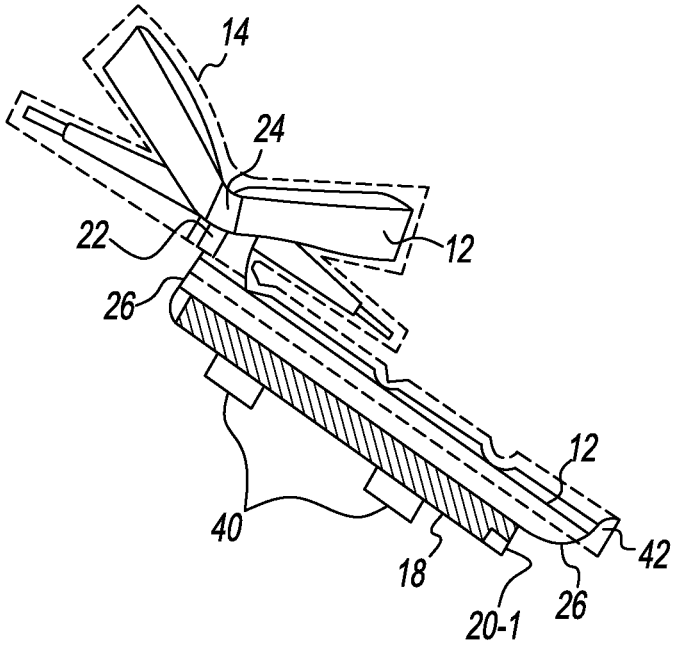
FIG. 2 is a side view of the shoe lace lights of FIG. 1.

Referring to FIGS. 1 and 2, a shoe lace light 10 may include a shoe lace looking material 12 encased in a housing 14. The shoe lace looking material 12 may be, for example, a natural or synthetic fiber-based material, such as woven cotton. In other embodiments, the shoe lace looking material 12 may be made of plastic or the like. The shoe lace looking material 12 may be designed to appear similar to conventional shoe laces. The housing 14 may be, for example, a clear plastic housing adapted to encase the shoe lace looking material 12 and keep the shoe lace looking material 12 from unknotting and unfolding. In some embodiments, the housing 14 may be a clear coating, such as a clear epoxy or a clear polyurethane or the like.

Lights 16, such as a string LED light, may be similarly encased in the housing 14, along with the shoe lace looking material 12. In some embodiments, as shown in FIG. 2, the lights 16 may be integrated into the shoe lace looking material 12. In some embodiments, the lights 16 may be disposed in a central portion of the shoe lace looking material 12, along the entire front exposed face of the shoe lace light 10.

The lights 16 may be powered by, for example, a battery pack 18. In some embodiments, the battery pack 18 may hold button-type batteries (not shown). In other embodiments, the battery pack 18 may hold standard cylindrical batteries, such as size "AAA" batteries. In some embodiments, the battery pack 18 may include one or more rechargeable batteries. Wires 26 may connect the battery pack 18 to the lights 16. In some embodiments, a charging input 20-1 may be disposed in the battery pack 18 to permit external power (not shown) to charge the battery pack 18. In other embodiments, one or more solar cells 20-2 may be disposed at or near the shoe lace looking material 12. For example, solar cells 20-2 may be disposed in the folds of the shoe lace looking material (as indicated by dashed lines in FIG. 1), whereby light can reach the solar cells 20-2, but the solar cells 20-2 may be at least partially hidden from view.

A switch 22 may be disposed to turn power to the lights 16 on and off from the battery pack 18. The switch 22 may be disposed in various locations. For example, the switch 22 may be disposed under a shoe lace knot 24 so that the user may push the knot 24 to switch between power on and power off.

One or more attachment devices 40 may be used to attach the shoe lace lights 10 to a shoe. The attachment devices 40 may be one or more clips, pins, buttons, hook and loop fasteners, and the like. In some embodiments, the shoe lace lights 10 may attach to a user's shoe laces. In other embodiments, the shoe lace lights 10 may attach to a hook and loop strap (in shoes without laces) of the shoe. This may allow a shoe lace look on shoes without laces. For example, a child's shoe, without laces, may be provided the look of laces with the shoe lace lights 10 of the present invention. The shoe lace lights 10 may also be used as a safety device, lighting up a user's shoes to provide safety to users when, for example, walking or running at night.

Figure 3:
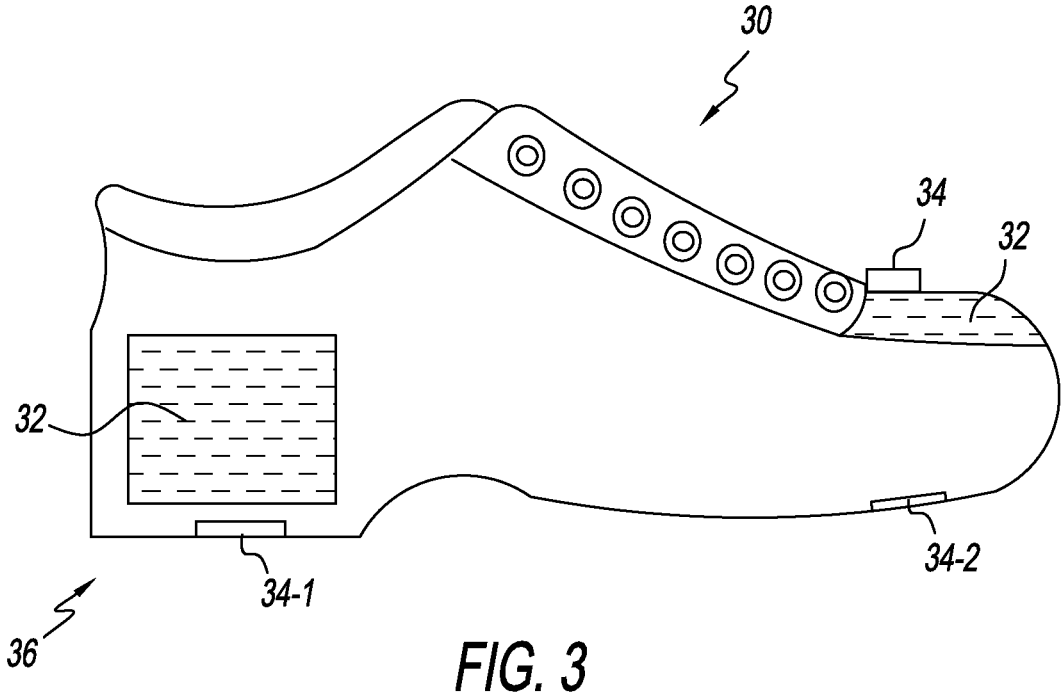
FIG. 3 is a side view of a shoe adapted to use the shoe lace lights of FIG. 1.

Referring to FIG. 3, a shoe 30 may be used to show various options for the shoe lace lights 10. In some embodiments, the shoe 30 may include solar panels 32 to power the shoe lace lights 10 (not shown). In some embodiments, the shoe lace lights 10 may plug into a power port 34 built into the shoe 30. The power port 34 may receive power from the solar panels 32, for example. In some embodiments, the power port 34 may receive power from batteries (not shown) that may be built into the shoe 30. In some embodiments, the shoe lace lights 10 may include a mating port 42 that is adapted to fit into the power port 34.

In some embodiments, a built-in power switch 34-1 may be built into a heel 36 of the shoe 30. In other embodiments, a built-in power switch 34-2 may be built into a toe 38 of the shoe 30. The power switches 34-1, 34-2 may be momentary closed switches such that when a user steps on their heel 36 or their toe 38, the switches 34-1, 34-2 may close and the lights 16 may light.

The shoe lace lights 10 may be made of various colors and styles. For example, the shoe lace looking material 12 may be formed of various colors and sizes. The lights 16 may be of one or more colors, or may be of multiple colors. The lights 16 may all shine when powered, or, in some embodiments, the lights 16 may shine in an interval or pattern.

It should be understood, of course, that the foregoing relates to exemplary embodiments of the invention and that modifications may be made without departing from the spirit and scope of the invention as set forth in the following claims.

What is claimed is:

1. A light assembly comprising:

a shoe lace looking material shaped similar to a laced and tied shoe lace;

a housing entirely encasing the shoe lace looking material, the housing retaining the shoe lace looking material in its shape and preventing untying thereof;

a light disposed in the housing;

a power pack adapted to provide power to the light; and an attachment device adapted to attach the light assembly to a shoe.

2. The light assembly of claim 1, wherein the housing is a clear material.

3. The light assembly of claim 1, wherein the light is centrally disposed within the shoe lace looking material.

4. The light assembly of claim 3, wherein the light is disposed along an entire front facing portion of the shoe lace looking material.

5. The light assembly of claim 1, wherein the power pack includes one or more rechargeable batteries.

6. The light assembly of claim 5, wherein the power pack includes a charging port.

7. The light assembly of claim 1, further comprising a switch for interrupting power supplied to the light.

8. The light assembly of claim 1, wherein the light includes one or more light emitting diodes (LEDs).

9. The light assembly of claim 8, wherein the light includes one or more string LEDs.

10. The light assembly of claim 1, further comprising a port adapted to fit into a power port of a shoe.

11. The light assembly of claim 1, further comprising one or more solar cells adapted to recharge the power pack.

* * * * *